US011638455B2

(12) United States Patent
Ishikawa

(10) Patent No.: US 11,638,455 B2
(45) Date of Patent: May 2, 2023

(54) HELMET AIRFLOW CONTROL MEMBER AND HELMET

(71) Applicant: SHOEI CO., LTD., Tokyo (JP)

(72) Inventor: Kyosuke Ishikawa, Tokyo (JP)

(73) Assignee: SHOEI CO., LTD., Tokyo (JP)

( * ) Notice: Subject to any disclaimer, the term of this patent is extended or adjusted under 35 U.S.C. 154(b) by 7 days.

(21) Appl. No.: 16/790,988

(22) Filed: Feb. 14, 2020

(65) Prior Publication Data

US 2020/0268087 A1 Aug. 27, 2020

(30) Foreign Application Priority Data

Feb. 22, 2019 (JP) ..... JP2019-030063

(51) Int. Cl.
*A42B 3/04* (2006.01)
*A42B 3/28* (2006.01)

(52) U.S. Cl.
CPC ..... *A42B 3/0493* (2013.01); *A42B 3/283* (2013.01)

(58) Field of Classification Search
CPC ..... A42B 3/0493; A42B 3/283; A42B 3/24; A42B 3/28; A42B 3/00; A42B 3/04
See application file for complete search history.

(56) References Cited

U.S. PATENT DOCUMENTS 3,496,854 A * 2/1970 Hill ..... A42B 3/28 2/410
3,502,074 A * 3/1970 Jones ..... A42B 3/228 292/256.65
3,860,966 A * 1/1975 Brown ..... A42B 3/28 2/415
4,519,099 A * 5/1985 Kamiya ..... A42B 3/281 D29/105
4,586,197 A * 5/1986 Hubbard ..... A42B 3/0493 2/425
4,698,856 A * 10/1987 Arai ..... A42B 3/283 2/425

(Continued)

FOREIGN PATENT DOCUMENTS

EP 0686358 A1 * 12/1995 ..... A42B 3/0493
EP 0775453 A1 * 5/1997 ..... A42B 3/281

(Continued)

*Primary Examiner* — F Griffin Hall
*Assistant Examiner* — Raquel M. Weis
(74) *Attorney, Agent, or Firm* — Cantor Colburn LLP

(57) ABSTRACT

A helmet airflow control member includes a plate-like main body arranged on a shell and including a main body rear surface that covers part of a shell outer surface, and at least one passage formation portion arranged on the main body rear surface. A periphery of the main body rear surface includes a first peripheral portion, which is shaped in correspondence with the shell outer surface and closes a space between the main body rear surface and the shell outer surface, and a second peripheral portion, which is spaced apart from the shell outer surface and defines an opening of the space between the main body rear surface and the shell outer surface in cooperation with the shell outer surface. The passage formation portion defines a passage in the space, with the passage extending from the opening into the space and returning from the space to the opening.

9 Claims, 4 Drawing Sheets

(56) References Cited

U.S. PATENT DOCUMENTS 4,704,746 A * 11/1987 Nava ..... A42B 3/24 2/184.5
4,731,885 A * 3/1988 Nava ..... A42B 3/283 2/424
4,903,348 A * 2/1990 Broersma ..... A42B 3/003 2/909
4,964,178 A * 10/1990 Giancarlo ..... A42B 3/281 2/171.7
4,995,117 A * 2/1991 Mirage ..... A42B 3/283 2/DIG. 1
5,086,520 A * 2/1992 Arai ..... A42B 3/283 2/424
5,097,538 A * 3/1992 Feuling ..... A42B 3/28 2/425
5,170,510 A * 12/1992 Nava ..... A42B 3/24 2/171.4
5,345,614 A * 9/1994 Tanaka ..... A42B 3/125 2/424
5,718,004 A * 2/1998 Broersma ..... A42B 3/28 2/425
5,867,840 A * 2/1999 Hirosawa ..... A42B 3/281 2/425
5,996,128 A * 12/1999 Yanagihara ..... A42B 3/281 2/425
6,061,834 A * 5/2000 Liao ..... A42B 3/283 2/411
6,105,172 A * 8/2000 Shida ..... A42B 3/24 2/424
6,263,513 B1 * 7/2001 Murakami ..... A42B 3/0493 2/424
6,317,891 B1 * 11/2001 Gafforio ..... A42B 3/283 2/410
D454,987 S * 3/2002 Hahm ..... D29/122
D457,274 S * 5/2002 Taniuchi ..... D29/102
D457,691 S * 5/2002 Taniuchi ..... D29/102
D458,415 S * 6/2002 Taniuchi ..... D29/102
D460,219 S * 7/2002 Taniuchi ..... D29/102
6,417,491 B1 * 7/2002 Taniuchi ..... H05B 3/84 219/528
6,763,526 B1 * 7/2004 Hong ..... A42B 3/283 2/424
6,910,228 B2 * 6/2005 Tanaka ..... A42B 3/0493 2/424
6,925,657 B2 * 8/2005 Takahashi ..... A42B 3/128 2/412
6,961,963 B2 * 11/2005 Rosie ..... A42B 3/28 128/201.24
6,973,676 B1 * 12/2005 Simpson ..... A42B 3/288 128/201.24
7,413,506 B2 * 8/2008 Arai ..... A42B 3/283 2/424
7,475,434 B2 * 1/2009 Ambuske ..... A42B 3/28 2/425
7,509,835 B2 * 3/2009 Beck ..... G01P 15/06 2/425
7,574,754 B2 * 8/2009 Arai ..... A42B 3/0493 2/410
7,748,059 B2 * 7/2010 Arai ..... A42B 3/0493 2/424
7,818,821 B2 * 10/2010 Shirai ..... A42B 3/281 2/424
7,987,525 B2 * 8/2011 Summers ..... A42B 3/281 2/410
8,127,375 B2 * 3/2012 Pierce ..... A42B 3/283 2/410
8,176,575 B2 * 5/2012 Tsuzuki ..... A42B 3/24 2/424
8,695,121 B2 * 4/2014 Nolan ..... A42B 3/24 2/424
8,726,425 B2 * 5/2014 Murakami ..... A42B 3/0493 2/455
D751,767 S * 3/2016 Shida ..... D29/107
9,370,217 B2 * 6/2016 Arai ..... A42B 3/283
D831,281 S * 10/2018 Nimura ..... D29/122
D835,851 S * 12/2018 Brown ..... D29/122
2001/0039674 A1 * 11/2001 Shida ..... A42B 3/283 2/414
2002/0124298 A1 * 9/2002 Muskovitz ..... A42B 3/283 2/425
2004/0158914 A1 * 8/2004 Tanaka ..... A42B 3/0493 2/410
2004/0187195 A1 * 9/2004 Wang Lee ..... A42B 3/281 2/410
2005/0060793 A1 * 3/2005 Rosie ..... A42B 3/28 2/424
2005/0066416 A1 * 3/2005 Ma ..... A42B 3/283 2/424
2005/0241049 A1 * 11/2005 Ambuske ..... A42B 3/06 2/412
2006/0179553 A1 * 8/2006 Kosel ..... A42B 3/28 2/422
2006/0230506 A1 * 10/2006 Shirai ..... A42B 3/281 2/410
2006/0248631 A1 * 11/2006 Arai ..... A42B 3/0493 2/424
2007/0050894 A1 * 3/2007 Tsurumi ..... A42B 3/283 2/413
2007/0192942 A1 * 8/2007 Ahn ..... A42B 3/283 2/410
2007/0226880 A1 * 10/2007 Shida ..... A42B 3/326 2/410
2007/0238405 A1 * 10/2007 Arai ..... A42B 3/283 454/121
2008/0134415 A1 * 6/2008 Pierce ..... A42B 3/283 2/410
2008/0201813 A1 * 8/2008 Yang ..... A42B 3/044 2/7
2009/0089918 A1 * 4/2009 Arai ..... A42B 3/0493 2/425
2010/0037372 A1 * 2/2010 Tsuzuki ..... A42B 3/24 2/424
2010/0095439 A1 * 4/2010 Nolan ..... A42B 3/286 2/15
2012/0167268 A1 * 7/2012 Crye ..... F41H 1/04 2/6.6
2015/0000012 A1 * 1/2015 Ikeda ..... A42B 3/281 2/411
2016/0106176 A1 * 4/2016 Gotti ..... A42B 3/066 2/425
2017/0215511 A1 * 8/2017 Albani ..... A42B 3/286
2018/0295926 A1 * 10/2018 Bouchard Fortin ... A42B 3/281
2019/0150548 A1 * 5/2019 Albani ..... B01D 53/0415

FOREIGN PATENT DOCUMENTS

EP 1714568 A1 * 10/2006 ..... A42B 3/0493
JP H226908 A 1/1990
JP H73516 A 1/1995
JP 2000328343 11/2000
WO WO-9304603 A1 * 3/1993 ..... A42B 3/0493
WO WO-02100204 A1 * 12/2002 ..... A42B 3/283
WO 2007144937 A1 12/2007
WO WO-2014199329 A1 * 12/2014 ..... A42B 3/066

* cited by examiner

HELMET AIRFLOW CONTROL MEMBER AND HELMET

BACKGROUND

1. Field

The present disclosure relates to a helmet airflow control member arranged on a shell of the helmet and a helmet including the helmet airflow control member.

2. Description of Related Art

Airflow generated by a helmet greatly affects how a wearer feels in the helmet. For example, airflow directed from the inside of a helmet toward the outside of the helmet greatly improves the ventilation performance of the helmet (for example, refer to Japanese Laid-Open Patent Publication No. 2-26908, Japanese Laid-Open Patent Publication No. 7-3516, and Japanese Laid-Open Patent Publication No. 2000-328343). Changes in airflow generated by the helmet are limited to decrease noise such as wind noise and significantly improve quietness. Disturbance in the airflow generated by the helmet is limited to significantly improve posture stability when traveling straight forward (for example, refer to International Publication No. WO 2007/144937).

A change in the shape of a shell of the helmet allows for a new control of the airflow generated by the helmet. However, the shell needs to have mechanical strength, impact resistance, and penetration resistance. This imposes limitations on detailed structures that can be added to control airflow.

SUMMARY

One object of the present disclosure is to provide a helmet airflow control member and a helmet that allow for a new control of airflow generated by the helmet.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a helmet airflow control member includes a plate-like main body and at least one passage formation portion. The main body is arranged on a shell and includes a main body rear surface that covers part of a shell outer surface. The passage formation portion is arranged on the main body rear surface. A periphery of the main body rear surface includes a first peripheral portion and a second peripheral portion. The first peripheral portion is shaped in correspondence with the shell outer surface and closes a space between the main body rear surface and the shell outer surface. The second peripheral portion is spaced apart from the shell outer surface and defines an opening of the space between the main body rear surface and the shell outer surface in cooperation with the shell outer surface. The passage formation portion defines a passage in the space, with the passage extending from the opening into the space and returning from the space to the opening.

In another general aspect, a helmet airflow control member includes a plate-like main body and at least one passage formation portion. The main body is arranged on a shell and includes a main body rear surface that covers part of a shell outer surface. The passage formation portion is arranged on the main body rear surface. A periphery of the main body rear surface includes a first peripheral portion and a second peripheral portion. The first peripheral portion is shaped in correspondence with the shell outer surface and closes a space between the main body rear surface and the shell outer surface. The second peripheral portion is spaced apart from the shell outer surface and defines an opening of the space between the main body rear surface and the shell outer surface in cooperation with the shell outer surface. The at least one passage formation portion includes at least one first passage formation portion and at least one second passage formation portion. The first passage formation portion defines a first passage extending from the opening into the space and returning from the space to the opening. The second passage formation portion is located adjacent to the at least one first passage formation portion to define a second passage extending from the space toward the opening and connected to a hole extending through the shell.

In one general aspect, a helmet includes a shell and a helmet airflow control member. The helmet airflow control member includes a plate-like main body and at least one a passage formation portion. The main body is arranged on the shell and includes a main body rear surface that covers part of a shell outer surface. The passage formation portion is arranged on the main body rear surface. A periphery of the main body rear surface includes a first peripheral portion and a second peripheral portion. The first peripheral portion is shaped in correspondence with the shell outer surface and closes a space between the main body rear surface and the shell outer surface. The second peripheral portion is spaced apart from the shell outer surface and defines an opening of the space between the main body rear surface and the shell outer surface in cooperation with the shell outer surface. The passage formation portion defines at least part of a passage in the space, with the passage extending from the opening into the space and returning from the space to the opening.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

Figure 1:
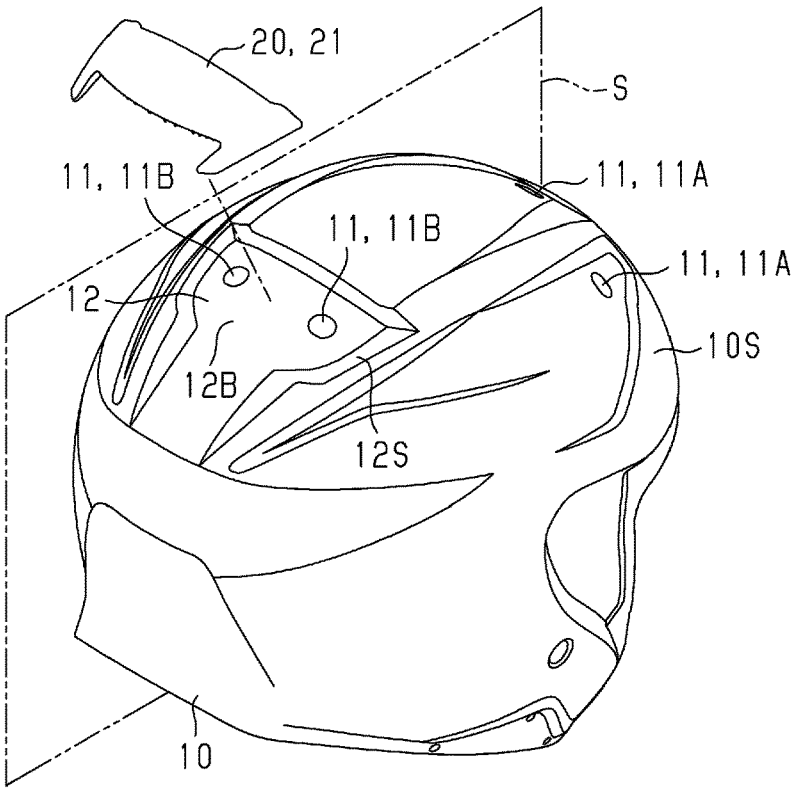
FIG. 1 is a perspective view showing a helmet taken from a rear upper side.
Figure 2:
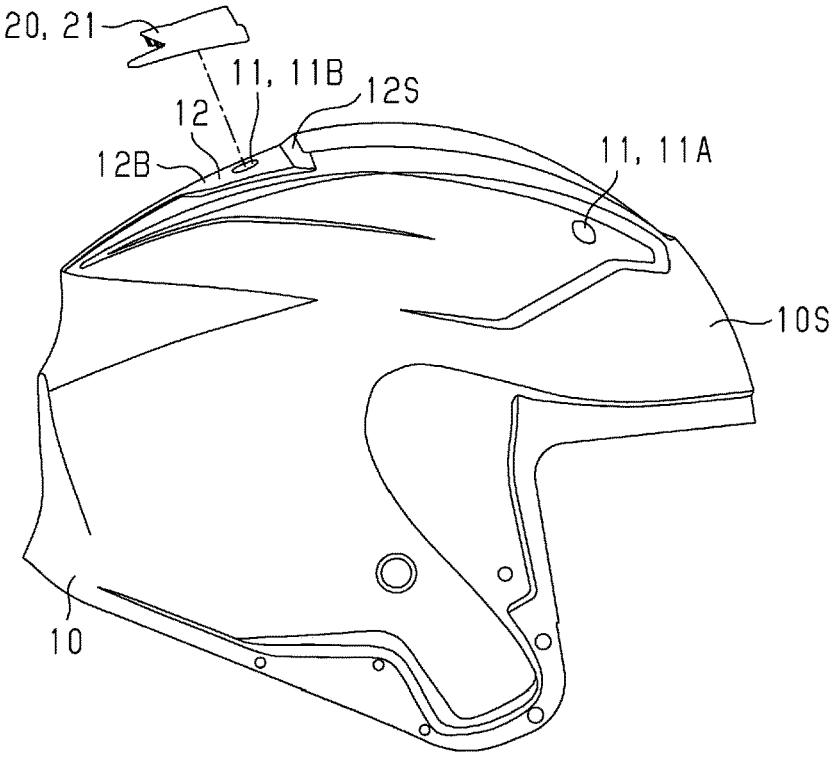
FIG. 2 is a side view showing the helmet of FIG. 1.
Figure 3:
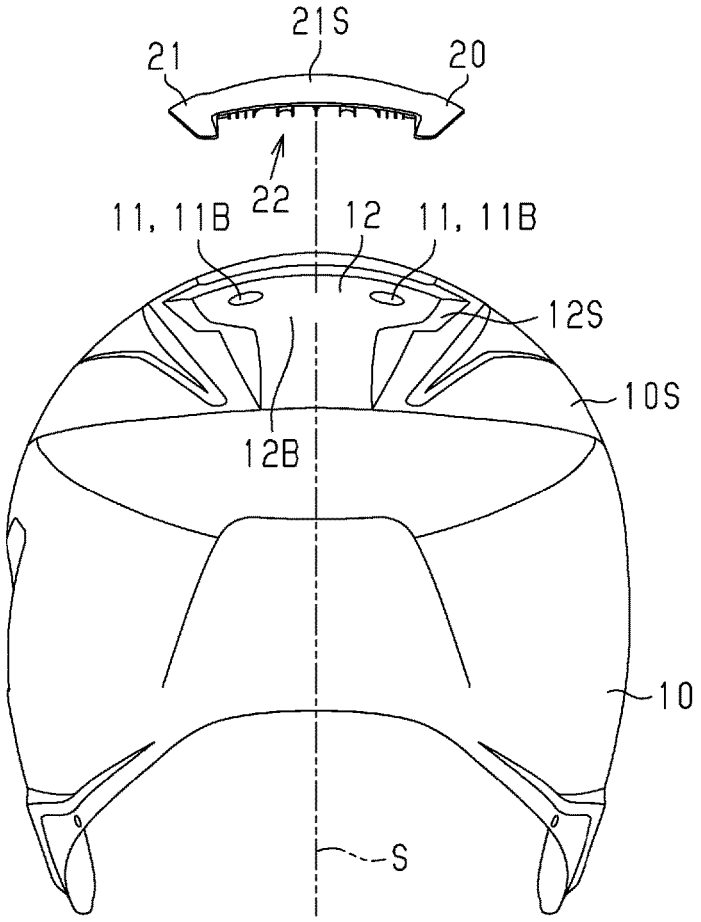
FIG. 3 is a rear view showing the helmet of FIG. 1.

One embodiment of a helmet airflow control member and a helmet will now be described with reference to FIGS. 1 to 6. In FIGS. 1 to 3, the helmet airflow control member is removed from a shell to facilitate the description of the helmet airflow control member. Further, a vertical plane extending from the center of the helmet with respect to the sideward direction when setting the helmet on a horizontal plane will be referred to as a symmetry plane S. Also, the front side of the helmet when traveling forward will be referred to as the front, and the opposite side of the front will be referred to as the rear.

As shown in FIG. 1, the helmet includes a shell 10 and an air outlet 20 that is one example of a helmet airflow control member (hereafter, also referred to as airflow control member).

The shell 10 forms an outer shell of the helmet. The shell 10 is a semispherical plastic member that is substantially plane-symmetric with respect to the symmetry plane S. The material for the shell 10 is selected from, for example, acrylonitrile-butadiene-styrene copolymer (ABS), polycarbonate (PC), and a thermosetting resin impregnated with reinforcement fibers.

The shell 10 may accommodate, for example, an impact absorption liner that is an interior member to absorb impacts. Further, the shell 10 may accommodate various types of pads having a lower repulsion force than the impact absorption liner, for example, to cushion the head. Also, the shell 10 may accommodate, for example, a shield support mechanism and a shield operation mechanism.

The shell 10 includes a shell outer surface 10S, which is an outer surface of the shell 10 and forms the outermost surface of the helmet. The shell outer surface 10S includes a plurality of ventilation holes 11. In the present embodiment, the ventilation holes 11 are circular and include air intake holes 11A and air discharge holes 11B. The air intake holes 11A are located in a front portion of the shell 10, and the air discharge holes 11B are located in a rear portion of the shell 10. The shell outer surface 10S does not have to include the air intake holes 11A. Further, the air discharge holes 11B may be located in only the rear portion of the shell 10 or a side portion of the shell 10.

The air intake holes 11A draw air into the shell 10. The air intake holes 11A are covered by a front intake (not shown) or an upper intake (not shown). The front intake or the upper intake is fixed to the shell outer surface 10S to form an opening directed toward the front of the helmet and guide air to the air intake holes 11A.

The air discharge holes 11B discharge heat and moisture out of the shell 10. In a case where the shell 10 accommodates an impact absorption liner, the impact absorption liner may form, for example, a passage that connects the air intake holes 11A and the air discharge holes 11B. Further, a passage that connects the inside of the impact absorption liner and the air discharge holes 11B may be formed in, for example, the impact absorption liner.

The air discharge holes 11B discharge the air drawn in through the air intake holes 11A or the residual air inside the impact absorption liner out of the shell 10. The diameter of the air discharge holes 11B is, for example, 6 mm or greater and 12 mm or less.

The air discharge holes 11B are covered by the air outlet 20. The air outlet 20 is fixed to the shell outer surface 10S to form an opening directed toward the rear of the helmet. The air outlet 20 guides the air exiting the air discharge holes 11B toward the rear of the helmet.

In a case where the air discharge holes 11B are located in the side portion of the shell 10, an air outlet fixed to the side portion of the shell 10 covers the air discharge holes 11B. The air outlet fixed to the side portion of the shell 10 also forms an opening directed toward the rear of the helmet to guide the air exiting the air discharge holes 11B toward the rear of the helmet.

As shown in FIG. 2, the shell outer surface 10S includes an outer surface coupling portion 12 used to couple the air outlet 20. The outer surface coupling portion 12 is a recess located in the shell outer surface 10S. The outer surface coupling portion 12 is located in the rear portion of the shell 10 at a central part with respect to the sideward direction of the shell 10. The outer surface coupling portion 12 includes inclined surfaces 12S, which are gradually inclined, and forms a smoothly curved surface in the shell outer surface 10S.

As shown in FIGS. 2 and 3, the outer surface coupling portion 12 includes a bottom surface 12B that is a three-dimensionally curved surface having a relatively small curvature in a front-rear direction and in the sideward direction. The bottom surface 12B of the outer surface coupling portion 12 includes two air discharge holes 11B. The two air discharge holes 11B are located in end portions of the outer surface coupling portion 12 with respect to the sideward direction. The air outlet 20 is coupled to the outer surface coupling portion 12 by, for example, screws, which extend into the bottom surface 12B, or an adhesive.

The air outlet 20 forms part of the outmost surface of the helmet. The air outlet 20 is a plastic plate member that is substantially plane-symmetric with respect to the symmetry plane S. The material of the air outlet 20 is selected from, for example, acrylonitrile-butadiene-styrene copolymer (ABS), polycarbonate (PC), or polypropylene (PP).

The air outlet 20 includes a main body 21 and a passage formation portion 22.

Main Body 21

The main body 21 includes a main body front surface 21S, which is a front surface of the main body 21. The main body front surface 21S is a three-dimensionally curved surface having a relatively small curvature in the front-rear direction and in the sideward direction. The main body 21 has the form of a curved plate such that the main body front surface 21S and the shell outer surface 10S appear as a continuous surface. The main body front surface 21S is a surface that regulates the airflow and reduces airflow disturbance in the rear portion of the helmet. Thus, the air outlet 20 functions as a stabilizer.

Figure 4:
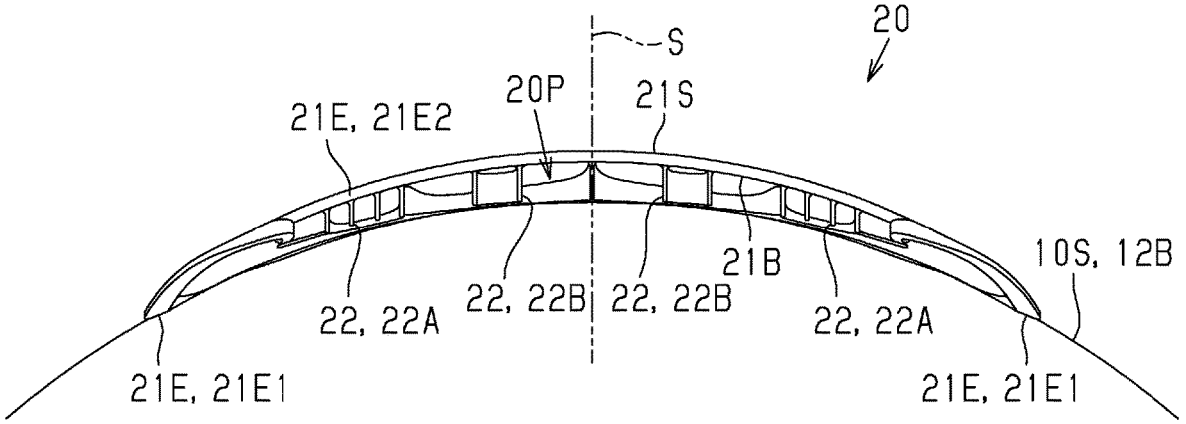
FIG. 4 is a rear view showing helmet airflow control member of the helmet of FIG. 1.
Figure 5:
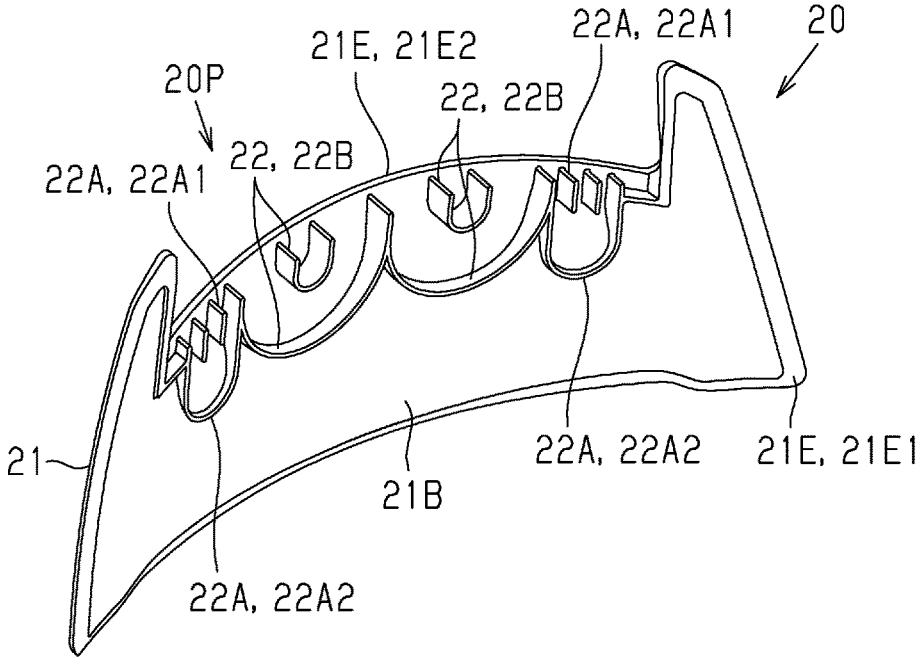
FIG. 5 is a perspective view showing the helmet airflow control member of the helmet of FIG. 1.

As shown in FIGS. 4 and 5, the main body 21 includes a main body rear surface 21B, which is a rear surface of the main body 21. The main body rear surface 21B has a smaller radius of curvature than the bottom surface 12B of the outer surface coupling portion 12 in the front-rear direction and in the sideward direction of the helmet. The difference in the radius of curvature forms a space between the main body rear surface 21B and the shell outer surface 10S.

A periphery 21E of the main body 21 includes a first peripheral portion 21E1 and a second peripheral portion 21E2.

The first peripheral portion 21E1 is shaped in correspondence with part of the shell outer surface 10S, for example, the inclined surfaces 12S of the outer surface coupling portion 12 or the bottom surface 12B of the outer surface coupling portion 12. The first peripheral portion 21E1 forms a front edge and side edges in the periphery 21E of the main body 21.

The first peripheral portion 21E1 closes the space between the main body rear surface 21B and the shell outer surface 10S. The first peripheral portion 21E1 is in contact with the shell outer surface 10S or located proximate to the shell outer surface 10S to close the space between the main body rear surface 21B and the shell outer surface 10S. The closing of the space is not limited to sealing the space through touch contact of the first peripheral portion 21E1 with the shell outer surface 10S. The closing of the space allows for the formation of a gap between the first peripheral portion 21E1 and the shell outer surface 10S so that air can flow through the gap and enter the space between the main body rear surface 21B and the shell outer surface 10S.

The air outlet 20 may be formed so that the first peripheral portion 21E1 can slide on the inclined surfaces 12S and be fitted to the inclined surfaces 12S. In this case, the air outlet 20 may be configured to be fitted to the shell 10 in a removable manner. This allows the position of the air outlet 20 to be changed relative to the shell 10 and the air outlet 20 to be removed from the shell 10 for replacement.

The second peripheral portion 21E2 is arcuate and spaced apart from the shell outer surface 10S. The second peripheral portion 21E2 forms the rear edge in the periphery 21E of the main body 21.

The second peripheral portion 21E2 and the bottom surface 12B of the outer surface coupling portion 12 define an opening 20P. The opening 20P is an arcuate slit extending along the shell outer surface 10S and opens the space between the main body rear surface 21B and the shell outer surface 10S. Opening the space means allowing for the generation of a larger amount of air flowing between the space, which extends between the main body rear surface 21B and the shell outer surface 10S, and the outside than when the space is closed.

The main body 21 may be shaped such that, for example, the radius of curvature of the main body rear surface 21B is greater than that of the bottom surface 12B as long as the main body 21 closes the space between the main body rear surface 21B and the shell outer surface 10S at the front and the sides and opens the opening 20P at the rear of the space. Further, the main body rear surface 21B may have the same shape as part of the shell outer surface 10S.

Passage Formation Portion 22

As shown in FIG. 4, the passage formation portion 22 is located on the main body rear surface 21B. The passage formation portion 22 includes left and right first passage formation portions 22B and left and right second passage formation portions 22A. The second passage formation portions 22A are located at opposite ends of the main body rear surface 21B in the sideward direction. The pair of the first passage formation portions 22B are located between the pair of the second passage formation portions 22A in the sideward direction. Specifically, one of the second passage formation portions 22A is located at the left side of the two first passage formation portions 22B, and the other one of the second passage formation portions 22A is located at the right side of the two first passage formation portions 22B. The two first passage formation portions 22B are substantially plane-symmetric with respect to the symmetry plane S. Also, the two second passage formation portions 22A are substantially plane-symmetric with respect to the symmetry plane S.

As shown in FIG. 5, the second passage formation portions 22A are formed by ribs projecting from the main body rear surface 21B toward the shell outer surface 10S. Each second passage formation portion 22A includes two open ribs 22A1 and one guide rib 22A2.

The guide rib 22A2 extends from the second peripheral portion 21E2, which defines the opening 20P, into the space between the main body rear surface 21B and the shell outer surface 10S. In a view of the main body rear surface 21B, the guide rib 22A2 is arcuate and protrudes from the second peripheral portion 21E2 into the space between the main body rear surface 21B and the shell outer surface 10S, that is, toward the front of the helmet. In other words, the guide rib 22A2 is U-shaped and is open toward the rear of the helmet.

Two ends of the arcuate guide rib 22A2 are located proximate to the second peripheral portion 21E2, which defines the opening 20P. Each guide rib 22A2 is disposed so that the guide rib 22A2 extends above and around a corresponding air discharge hole 11B and is open toward the opening 20P. Thus, each guide rib 22A2 defines a passage (second passage) from the air discharge hole 11B toward the opening 20P. The guide rib 22A2 serves as a boundary of the second passage, which is part of the space, and other portions of the space. In this manner, the guide rib 22A2 and the main body rear surface 21B form the second passage in the space.

The two open ribs 22A1 are located proximate to the second peripheral portion 21E2, which defines the opening 20P. The two open ribs 22A1 are located between two ends of the corresponding guide rib 22A2. The two open ribs 22A1 divide the passage formed by the guide rib 22A2 into three passages at the opening 20P. In other words, the two open ribs 22A1 partition the second passage formed by the guide rib 22A2 and divide the second passage into three passages at the opening 20P.

Each first passage formation portion 22B includes two ribs projecting from the main body rear surface 21B toward the shell outer surface 10S. In a view of the main body rear surface 21B, the ribs of the first passage formation portion 22B are each arcuate and protrude from the second peripheral portion 21E2 into the space between the main body rear surface 21B and the shell outer surface 10S, that is, toward the front of the helmet. In other words, the ribs of the first passage formation portion 22B are each U-shaped and open toward the rear of the helmet. In the view of the main body rear surface 21B, one of the ribs of the first passage formation portion 22B is located at the inner side of the other one of the ribs.

The two ribs of the first passage formation portion 22B extend from the opening 20P into the space between the main body rear surface 21B and the shell outer surface 10S and define a passage (first passage) returning to the opening 20P from the space between the main body rear surface 21B and the shell outer surface 10S. Thus, the first passage formation portion 22B includes two ribs that define the first passage. The first passage formation portion 22B also serves as a boundary between the first passage, which is part of the space, and other portions of the space. The first passage formation portion 22B is configured to divide the space into the first passage and other portions of the space. In this manner, the first passage formation portion 22B and the main body rear surface 21B form the first passage in the space. In the view of the main body rear surface 21B, the first passage is U-shaped and protrudes from the second peripheral portion 21E2 (opening 20P) toward the inner side of the main body 21 (into the space). In other words, the first passage is U-shaped and open toward the rear of the helmet.

Between the adjacent ones of second passage formation portion 22A and the first passage formation portion 22B, one end of the guide rib 22A2 of the second passage formation portion 22A is coupled to one end of the outer rib of the first passage formation portion 22B at the second peripheral portion 21E2. Between the two adjacent first passage formation portions 22B, one end of the outer rib of one first passage formation portions 22B is coupled to one end of the outer rib of the other first passage formation portion 22B at the second peripheral portion 21E2. This increases the mechanical strength of the ribs that form the passage formation portion 22.

Operation

Figure 6:
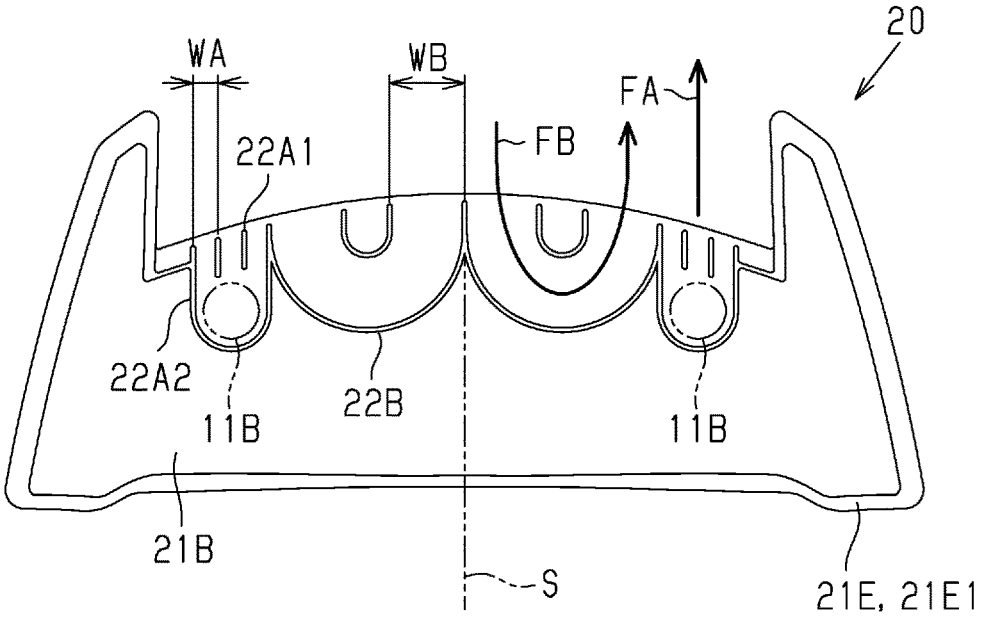
FIG. 6 is a plan view showing a rear surface of the helmet airflow control member of FIG. 5.

As shown in FIG. 6, the air inside the shell 10 including hot air or moisture exits the air discharge holes 11B of the shell outer surface 10S and flows through the passage defined by the guide ribs 22A2. Then, the hot air or moisture from the inside of the shell 10 is discharged as a discharged airflow FA through the opening 20P, which is formed by the second peripheral portion 21E2 of the air outlet 20 and the shell outer surface 10S, toward the rear of the helmet.

In this case, the step between the shell outer surface 10S and the main body front surface 21S generates a turbulent airflow near the opening 20P. The turbulent airflow includes airflow FB directed toward the opening 20P. According to experiments conducted by the inventors of the present invention, for example, when the wind velocity is 100 km/h and the diameter of the ventilation holes 11 is 6 mm or greater and 12 mm or less, the pressure distribution in the vicinity of the second peripheral portion 21E2 has a tendency to be higher at the central part in the sideward direction and lower toward the opposite ends in the sideward direction. As a result, the airflow FB enters the passage defined by each first passage formation portion 22B from an entrance close to the central part of the second peripheral portion 21E2 and is discharged from an exit that is close to the adjacent passage defined by the guide rib 22A2.

More specifically, based on the distribution of the negative pressure at the second peripheral portion 21E2, the first passage formation portion 22B generates the airflow FB directed from the space between the shell outer surface 10S and the main body rear surface 21B toward the rear. Consequently, the airflow FB aids the discharged airflow FA to increase the ventilation efficiency inside the shell 10.

Further, the open ribs 22A1 divide and narrow a sideward width WA of the passage defined by the second passage formation portion 22A at the opening 20P so that a returning airflow like the airflow FB will not be generated. This regulates the discharged airflow FA and further improves the ventilation efficiency inside the shell 10.

The amount of discharged air can be increased by increasing the number of discharge passages or the cross-sectional flow area of the discharge passages. However, the air discharge holes 11B, which are part of the discharge passages, extend through the shell 10. Thus, an increase in the number of the air discharge holes or enlargement of the air discharge holes to increase the cross-sectional flow area of the discharge passages will lower the mechanical strength, the impact resistance, and the penetration resistance of the shell 10. Further, additional ribs or increased thickness of the shell 10 to raise the mechanical strength, the impact resistance, and the penetration resistance of the shell 10 will increase the weight of the helmet and manufacturing costs.

In this respect, the air outlet 20 including the passage formation portion 22 and the passage formation portion 22 configured to improve the ventilation efficiency readily obtain the mechanical strength of the shell 10 and the impact resistance of the shell 10.

In a comparative example, a shutter mechanism that opens and closes the air discharge holes 11B will prevent rain water from entering the air discharge holes 11B. However, the addition of a separate shutter mechanism will increase the number of parts of the helmet and the manufacturing cost of the helmet. In this respect, the air outlet 20 of the present embodiment configured to cover the air discharge holes 11B will limit increases in the number of parts and the manufacturing cost.

The above-described embodiment has the following advantages.

(1) The distribution of positive pressure and negative pressure occurs at a certain extent in the vicinity of the opening of the space between the shell outer surface and the main body rear surface because of various factors such as the entire shape of the shell outer surface, the shape of part of the shell outer surface, the dimensions of parts of the shell outer surface, and the shapes of accessories attached to the shell outer surface. In the above embodiment, positive pressure and negative pressure may be distributed in the vicinity of the opening 20P of the space between the shell outer surface 10S and the main body rear surface 21B because of the location of the main body 21 on the shell outer surface 10S, the shape of the shell outer surface 10S, and the like. In the above-described structure, the passages (first passages) that extend from the opening 20P through the space and return to the opening 20P from the space are defined in the space between the shell outer surface 10S and the main body rear surface 21B. In this manner, the air drawn from one portion of the opening 20P into the space flows out of another portion of the opening 20P. This reduces the difference of the positive pressure and the negative pressure in the vicinity of the opening 20P. As a result, the structure of the air outlet 20, which is a member separate from the shell 10, allows for a new control of the airflow compared to comparative examples lacking the above-described structure of the air outlet 20 and the shell 10.

(2) The passage that extends from the opening 20P into the space and returns to the opening 20P from the space is defined by the ribs. This reduces the amount of material used to form the passage as compared with, for example, a structure in which the thickness of the main body 21 is increased from the above embodiment to form a groove defining the passage in the main body rear surface 21B.

(3) In addition to the first passage formation portions 22B, which define the passages (first passages) that reduce the difference of the positive pressure and the negative pressure in the vicinity of the opening 20P, the air outlet 20 includes the second passage formation portions 22A, which define the passages (second passages) that connect the inside and the outside of the shell 10. The second passage formation portions 22A extend from the space toward the opening 20P and are connected to the air discharge holes 11B, which extend through the shell 10. The airflow FB generated by each of the first passages, which are defined by the first passage formation portions 22B, increases the velocity of the discharged airflow FA generated by each of the second passages, which are defined by the second passage formation portions 22A. This improves the ventilation efficiency inside the shell 10.

(4) The air outlet 20 is located at the center at the rear portion of the shell 10 with respect to the sideward direction, and the first passage formation portions 22B and the second passage formation portions 22A are each symmetric in the sideward direction. This increase the stability of the air outlet 20. Specifically, the air outlet 20 includes the left and right first passage formation portions 22B and the left and right second passage formation portions 22A that sandwich the first passage formation portions 22B in the sideward direction. This reduces the difference of the positive pressure and the negative pressure in the vicinity of the opening 20P at the left and right sides of the shell 10.

Further, the ventilation performance obtained by the connection between the inside and the outside of the shell 10 can be improved at the left and right sides of the shell 10. As a result, the air outlet improves airflow controllability at the left and right sides of the shell 10 in the same manner. Since the airflow controllability at the right side is the same as the airflow controllability at the left side, stability is improved, that is, stability is improved in the sideward direction when traveling.

(5) In a view of the main body rear surface 21B, the first passages defined by the first passage formation portions 22B are U-shaped and protrude from the opening 20P into the space. In other words, the first passages defined by the first passage formation portions 22B are U-shaped and protrude toward the front of the helmet. Thus, the airflow directed from the opening 20P into the space is smoothly returned from the space to the opening 20P. This also reduces pressure loss in the passages defined by the first passage formation portions 22B.

(6) The air outlet 20 serves as a stabilizer including a surface that regulates the airflow and improves the ventilation performance Thus, airflow disturbances are reduced and the ventilation performance is improved when the single air outlet 20 is used.

The above embodiment may be modified as described below.

Airflow Control Member

The airflow control member is not limited to a top air outlet fixed to the rear portion of the shell 10. For example, the airflow control member may be changed to, for example, a side air outlet fixed to a side surface of the shell 10.

The airflow control member may be modified as long as it includes at least one first passage formation portion 22B and at least one the second passage formation portion 22A adjacent to the first passage formation portion 22B. For example, an airflow control member that serves as a stabilizer may be arranged on each of the two side surfaces of the shell 10. In this case, the shell 10 only includes one or more holes extending through the shell 10 and one or more passages for each airflow control member.

The passage formation portion of the airflow control member is applicable to a spoiler that serves as a resistance against the airflow and upwardly deflects the airflow. Specifically, the passage formation portion can be arranged on a rear surface of the spoiler facing the shell outer surface 10S.

The passage formation portion of the airflow control member is applicable to a diffuser that diffuses the airflow. Specifically, the passage formation portion can be arranged on a rear surface of the diffuser facing the shell outer surface 10S.

The second passage formation portion 22A can be omitted from the airflow control member. Even in this structure, when the airflow control member reduces the difference of the positive pressure and the negative pressure, changes and disturbances in the airflow are reduced. This allows for a new control of the airflow that increases quietness or improves posture stability.

Figure 7:
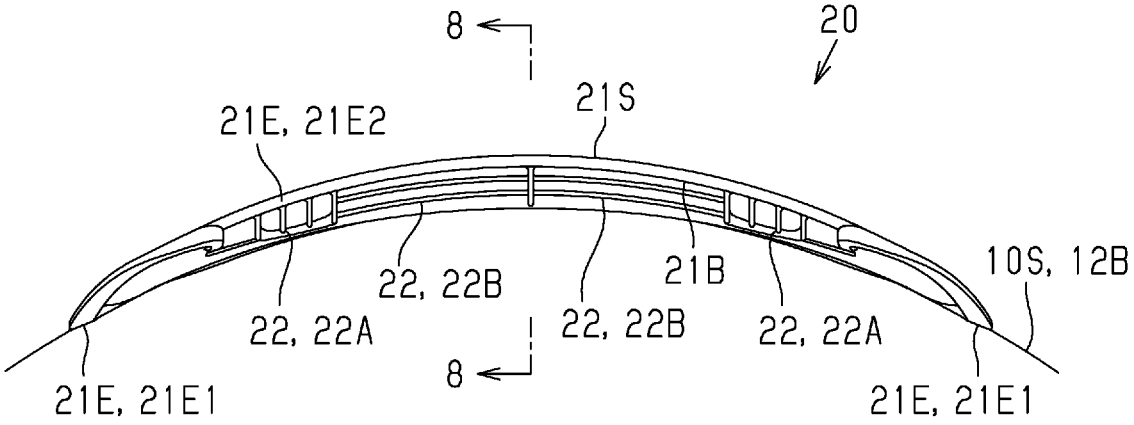
FIG. 7 is a rear view showing the structure of a helmet airflow control member in accordance with a modified example.
Figure 8:
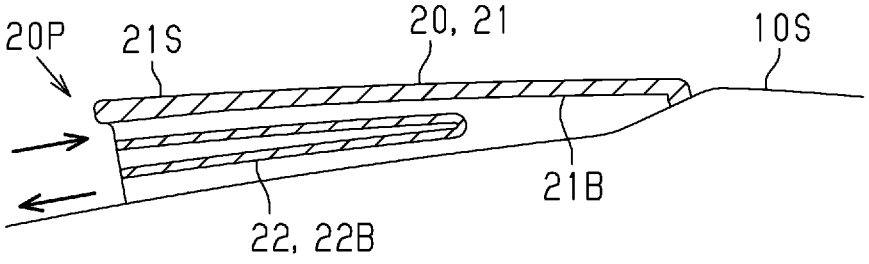
FIG. 8 is a cross-sectional view taken along line 8-8 in FIG. 7.

In the first passage formation portion 22B of the above embodiment, the two ribs projecting from the main body rear surface 21B toward the shell outer surface 10S divide the opening 20P in the sideward direction. Instead, as shown in FIG. 7, the first passage formation portion 22B can be configured to divide the opening 20P in a vertical direction. In this case, as shown in FIG. 8, the first passage formation portion 22B defines a passage that extends from the upper side of the opening 20P into the space and then from the space to the lower side of the opening 20P. Specifically, the first passage formation portion 22B divides part of the opening 20P in the vertical direction to define an upper opening and a lower opening and connect the upper opening and the lower opening in the space between the main body rear surface 21B and the shell outer surface 10S. For example, the first passage formation portion 22B includes a partition plate that divides the opening 20P in the vertical direction and an outer rib located at the outer side of the partition plate. The partition plate divides the opening 20P in the vertical direction and extends from the opening 20P into the space. The partition plate is formed integrally with the outer rib and defines passages that are connected at the inner side of the outer rib. This defines the passage that extends from the upper side of the opening 20P into the space and from the space to the lower side of the opening 20P.

The air passing by the main body front surface 21S generates a disturbed airflow at the rear end of the main body front surface 21S. Thus, in the above modified example vertically connecting the opening 20P with the passage, the air flowing into the upper opening proximate to the rear end of the main body front surface 21S is discharged from the lower opening. Further, outer surface shapes of the outer surface coupling portion 12 and the air outlet 20 can be changed to draw air into the lower opening and discharge from the upper opening of the first passage formation portion 22B. In this manner, the first passage formation portion 22B formed in the vertical direction decreases the width of the air outlet 20 in the sideward direction. This allows for the helmet airflow control member to be reduced in size and weight.

The passage defined by the first passage formation portion 22B may be V-shaped and protrude toward the front of the helmet or U-shaped to have right-angle corners and protrude toward the front of the helmet. The passage defined by the first passage formation portion 22B may have any shape as long as airflow is directed from the opening 20P into the space and returned from the space toward the opening 20P.

The passage that generates the discharged airflow FA may be formed by the airflow control member in cooperation with the shell. For example, the airflow control member may include the open ribs 22A1, and the shell outer surface 10S may include the guide rib 22A2. This structure also has better mechanical strength and impact resistance in the shell 10 compared to a structure in which the passage formation portion is arranged on the shell outer surface 10S.

The passage that generates the airflow FB may be formed by the airflow control member in cooperation with the shell. For example, the airflow control member may include the inner rib, and the shell outer surface 10S may include the outer rib. This structure also has better mechanical strength and impact resistance in the shell 10 compared to a structure in which the passage formation portion is arranged on the shell outer surface 10S.

Helmet

The helmet is not limited to be of a full face type and can be changed to various types of helmets such as a flip up type helmet, of which a chin portion can be lifted, or an open face type helmet, which does not have a chin portion.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A helmet, comprising:

a shell including air intake openings located in a front portion of the shell and a recessed portion including air discharge openings located in a rear portion of the shell; and a helmet airflow control member seated within the recessed portion, wherein the helmet airflow control member has a shape complementary to the recessed portion including a main body arranged on the shell and including a main body front surface and a main body rear surface, wherein the main body front surface is configured to appear as a flush and continuous surface with an outer surface of the shell when attached thereto, and wherein the main body rear surface is spaced apart from the outer surface to provide an opening between the main body and the shell, and a plurality of ribs extending from a bottom surface of the main body to the shell within the opening, wherein the plurality of ribs define first u-shaped channel and a first air discharge channel adjacent to the first u-shaped channel, wherein the first air discharge channel Overlies and is in fluid communication with one of the air discharge openings in the shell and the opening, and wherein the u-shaped channel defines a curvilinear passage within the opening extending from and returning to the main body rear surface to provide an increase in ventilation efficiency of air flowing through the first air discharge opening in the shell through the first air discharge channel and out the helmet airflow control member when in use.

2. The helmet according to claim 1, wherein the helmet airflow control member further comprises a second air discharge channel adjacent to a second u-shaped channel, wherein the second air discharge channel overlies an other one of the discharge openings in the shell, and the second u-shaped channel provides an increase in ventilation efficiency of air flowing through the other one of the air discharge openings in the shell through the second air discharge channel and out the helmet airflow control member when in use.

3. The helmet according to claim 2, wherein the first u-shaped channel and adjacent discharge channel is arranged adjacent to the second u-shaped channel and adjacent air discharge channel at left and right passage formation portions arranged next to each other.

4. A helmet airflow control member, comprising: a main body including a main body front surface and a main body rear surface configured to cover part of a shell outer surface of a helmet; and a passage formation portion arranged on a bottom surface of the main body defined by a plurality of ribs extending from the bottom surface, wherein the passage formation portion includes a u-shaped channel comprising, when in use, a first fluid passage that is curvilinear in shape extending to and-from the main body rear surface, and an air discharge channel adjacent to the u-shaped channel to define, when in use, a second fluid passage to the main body rear surface.

5. A helmet airflow control member for a helmet shell, comprising:

a main body including a main body front surface, a main body rear surface, wherein the main body has a smooth top surface and a bottom surface including at least one passage formation portion defined by a plurality of ribs extending from the bottom surface and proximate to the main rear surface;

wherein the main body rear surface is configured to be raised when the airflow control member is attached to the helmet shell to provide an opening to the at least one passage formation, wherein the at least one passage formation portion comprises at least one u-shaped channel adjacent to an air discharge channel, wherein the air discharge channel is configured to be in fluid communication with an interior of the helmet shell and discharge air flow flowing into the helmet shell when in use, and wherein the at least one u-shaped channel is configured to increase ventilation efficiency of the air flowing through the discharge channel.

6. The helmet airflow control member of claim 5, further comprising at least one linear rib provided in a flow path of the air discharge channel.

7. The helmet airflow control member of claim 5, wherein the air discharge channel is defined by a single u-shaped rib and the u-shaped channel is defined by two u-shaped ribs spaced apart from one another.

8. The helmet airflow control member of claim 5, wherein the at least one passage formation portion is configured to divide the opening in a vertical direction.

9. The helmet airflow control member of claim 5, wherein the main body comprises two passage formation portions adjacently arranged on a left side and a right side of the main body.

* * * * *